United States Patent [19]

Sakamaki et al.

[11] 4,061,446

[45] Dec. 6, 1977

[54] ROTARY AIR PUMP OR COMPRESSOR WITH FLEXIBLE END SEALING PLATES

[75] Inventors: Hiroshi Sakamaki, Utsunomiya; Toshiyuki Maeda, Ageo; Toshimitsu Sakai, Okazaki; Tadashi Saitou, Toyota, all of Japan

[73] Assignees: Nippon Piston Ring Kabushiki Kaisha, Tokyo; Toyota Jidosha Kogyo Kabushiki Kaisha, Toyota, both of Japan

[21] Appl. No.: 679,444

[22] Filed: Apr. 22, 1976

[30] Foreign Application Priority Data

May 1, 1975 Japan ..... 50-59238[U]

[51] Int. Cl.[2] ..... F01C 19/08; F01C 5/06; F04C 27/00

[52] U.S. Cl. ..... 418/133; 418/153

[58] Field of Search ..... 418/131, 133, 135, 152, 418/153, 156

[56] References Cited

U.S. PATENT DOCUMENTS

| | | | |
|---|---|---|---|
| 1,879,136 | 9/1932 | Dubrovin | 418/133 |
| 3,096,720 | 7/1963 | Younger | 418/170 |
| 3,121,528 | 2/1964 | Rhodes | 418/152 |
| 3,334,591 | 8/1967 | Dymond | 418/133 |
| 3,695,791 | 10/1972 | Brundage | 418/133 |

FOREIGN PATENT DOCUMENTS

| | | | |
|---|---|---|---|
| 2,054,033 | 5/1972 | Germany | 418/131 |

*Primary Examiner*—John J. Vrablik

*Attorney, Agent, or Firm*—Stevens, Davis, Miller & Mosher

[57] ABSTRACT

A rotary fluid pump or compressor having a pair of flexible diaphragm type sealing plates which are clamped on opposite ends of a stator housing by end heads to form a cylindrical pump cavity and to be pressed onto the opposite end faces of a rotor driven within the pump cavity so as to provide sealing between the suction, compression and delivery chambers. Each of the sealing plates comprises a flat flange portion clamped between the end faces of the stator housing and the end head and a substantially cone shaped portion extending radially inwardly from the flat flange portion to be pressed onto the end face of the rotor and substantially coinciding at its apex with the axis of the rotor.

4 Claims, 6 Drawing Figures

ROTARY AIR PUMP OR COMPRESSOR WITH FLEXIBLE END SEALING PLATES

BACKGROUND OF THE INVENTION

The present invention relates to rotary fluid pumps or compressors, and more particularly to a rotary fluid pump or compressor wherein a rotor is eccentrically mounted within a stator housing and co-operates with the inner peripheral wall of the stator housing and with suitable end wall structure to form suction, compression and delivery chambers so as to produce compressed air or vacuum.

One of the present inventors previously introduced a rotary fluid pump of the type in which a pair of flexible diaphragm type sealing plates are hermetically clamped on the opposite ends of a stator housing by end wall structures to be pressed against the opposite end faces of a rotor driven within the pump cavity to increase the volumetric efficiency of the pump. In use of the rotary fluid pump to ensure the volumetric efficiency of the pump, it is necessary that the flexible sealing plates are constantly pressed against the opposite end faces of the rotor by difference between internal pressure produced within the pump cavity and external pressure applied to the outside faces of the sealing plates.

One of the problems experienced in development of such a pump is that the end-face sealing contacts of the sealing plates against the opposite end faces of the rotor cannot be obtained during rotation of the pump at a low speed. Namely, it is only when the pump is rotated at a high speed say over 1,500 r.p.m., that the necessary high vacuum of over −650 mmHg is obtainable.

SUMMARY OF THE INVENTION

The main object of the present invention is, therefore, to provide an improved rotary fluid pump or compressor by which a necessary high vacuum or high positive pressure becomes obtainable even when the pump or compressor is rotated at a low speed of about 400 to 600 r.p.m., thereby to reduce frictional defacement of the sealing plates and assure the durability of the pump or compressor.

According to the present invention, the above-mentioned object is accomplished by providing an improved rotary fluid pump or compressor wherein each of the sealing plates comprises a flat peripheral flange portion clamped between the end faces of the stator housing and the end wall structure and a substantially cone shaped portion extending radially inwardly from the flat peripheral flange portion to be pressed against the end face of the rotor and substantially coinciding at its apex with the axis of the rotor, the height of the cone shaped portion from the inner surface of the flat flange portion being determined in a range of $$\frac{\text{Inner diameter of the pump cavity}}{5 \times 10^2 \text{ to } 5 \times 10^3}.$$

BRIEF DESCRIPTION OF THE DRAWINGS

Other objects and advantages of the present invention will become apparent from the following detailed description, reference being had to the accompanying drawings in which.

DESCRIPTION OF THE PREFERRED EMBODIMENTS

Figure 1:
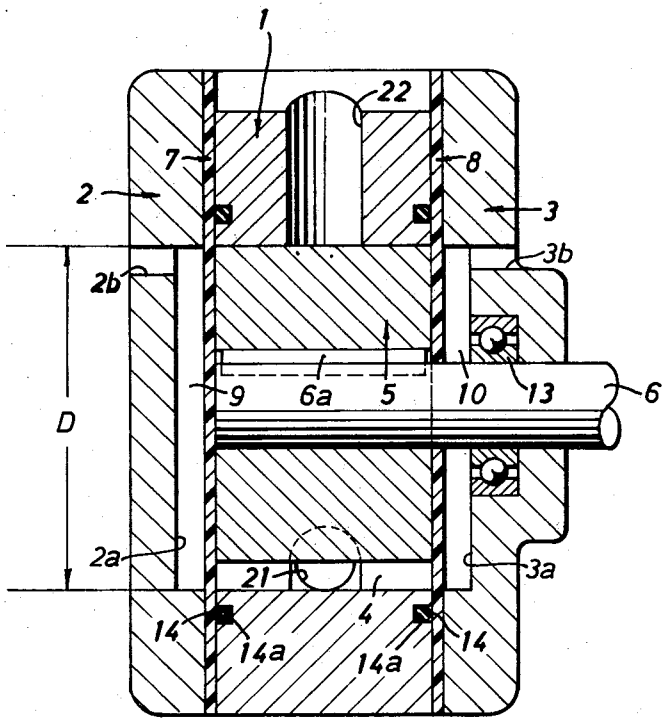
FIG. 1 shows a vertical cross-section of a rotary fluid pump having a pair of diaphragm type sealing plates.

Referring now to the drawings, particularly in FIG. 1, there is illustrated a dry air rotary pump as known in the prior art. The rotary pump comprises a stator housing 1 having an inlet or low pressure port 21 and an outlet or high pressure port 22 and a pair of end heads 2 and 3 hermetically secured to the opposite ends of the stator housing 1 by way of diaphragm type flexible sealing plates 7 and 8. Within a cylindrical pump cavity 4 formed by the inner peripheral wall of the stator housing 1 and the sealing plates 7 and 8, a rotor 5 is fixedly keyed on a drive shaft 6 which is journalled on the end head 3 through a ball bearings 13 and positioned eccentrically to the axis of the inner peripheral wall of the stator housing 1. On the inner walls of the end heads 2 and 3, circular recesses **2*a* and 3*a* are respectively provided to form a pair of pressure chambers 9 and 10 which are closed by the sealing plates 7 and 8 and communicated with the atmosphere through ports 2*b* and 3*b***.

In operation of such a dry air rotary pump, when the rotary pump is driven as a vacuum pump, the flexible sealing plates 7 and 8 are pressed against the opposite end faces of the rotor 5 due to difference between negative pressure generating within pump cavity 4 and the atmospheric pressure within pressure chambers 9 and 10. Thus, the suction, compression and delivery chambers within the pump cavity are air-tightly isolated one from another by means of end-face sealing contacts of sealing plates 7 and 8 with the opposite end faces of rotor 5 to ensure the volumetric efficiency of the pump.

With the aforementioned rotary pump, the end-face sealing contacts of the sealing plates 7 and 8 with the rotor 5 are greatly influenced by flexure of the sealing plates. Therefore, when the rotary pump is driven at a low speed of about 400 to 600 r.p.m., conventional sealing plates 7 and 8 may not be sufficiently pressed to the opposite end faces of the rotor 5. As a result, the end-face sealing of the sealing plates with the rotor 5 is poor and reduces the volumetric efficiency of the pump.

Figure 2:
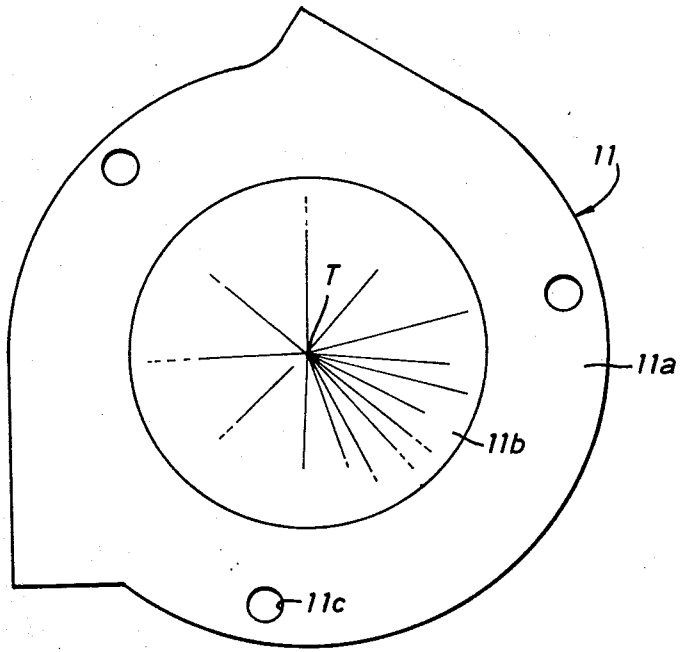
FIG. 2 is a front view of an improved cone shaped sealing plate in accordance with the present invention to be assembled with the rotary fluid pump of FIG. 1.
Figure 3:
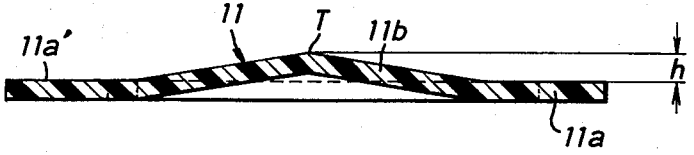
FIG. 3 is a cross-sectional view of the cone shaped sealing plate of FIG. 2.

In the preferred embodiment of the present invention, the drawback mentioned above is avoided by providing improved sealing plates 11 and 12 shown in FIGS. 2 to 5. In FIGS. 2 and 3, a front and a cross-section of the sealing plate 11, the proportions are exaggerated for purposes of illustration. This sealing plate 11 has a flat peripheral flange portion **11*a* interposed and clamped between the stator housing 1 and the end head 2 and a cone shaped portion 11*b* extending radially inwardly from the flat flange portion 11*a* with a uniform thickness. When the sealing plate 11** is assembled with the aforementioned rotary pump, the cone shaped portion 11*b* protrudes axially inwardly to be pressed onto the end-face of rotor 5 and coincides at its apex T with the axis of rotor 5.

In this sealing plate 11, the height *h* of the cone shaped portion 11*b* from the inner surface 11*a'* of the flat flange portion 11*a* is determined in a range of ($D/5 \times 10^2$ to $5 \times 10^3$), the character D representing the inner diameter of the pump cavity 4. For example, if the inner diameter D of pump cavity 4 is 100mm, the height *h* of the cone shaped portion 11*b* is determined to be 0.2 to 0.02mm.

The height *h* of the cone shaped portion 11*b* is determined by the following reasoning: if the height *h* is less than ($D/5 \times 10^3$), the end-face sealing contact of the sealing plate 11 with the rotor 5 becomes poor when the pump is rotated at a low speed. Conversely, if the height *h* is greater than $D/5 \times 10^2$, the sealing plate 11 is excessively urged onto the end-face of the rotor 5 to increase frictional defacement of the sealing plate 11 and the rotor 5.

Figure 4:
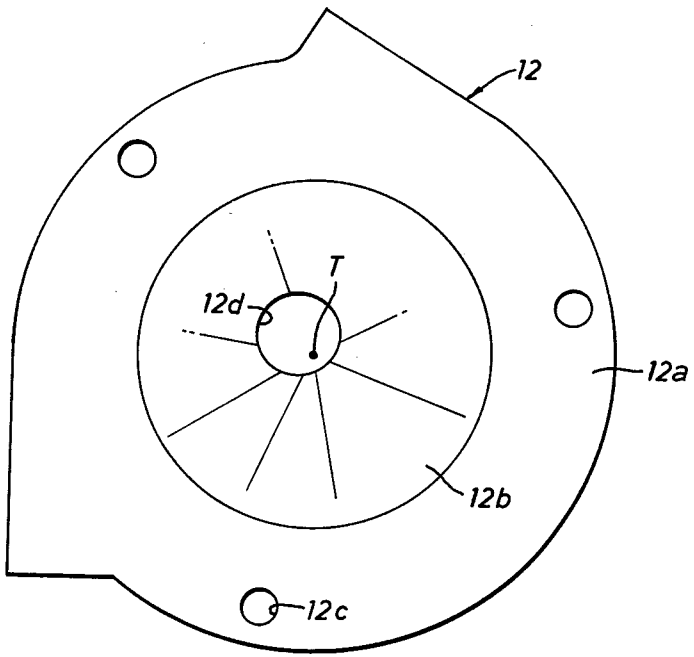
FIG. 4 is a front view of another improved truncated cone shaped sealing plate in accordance with the present invention to be assembled with the rotary fluid pump of FIG. 1.
Figure 5:
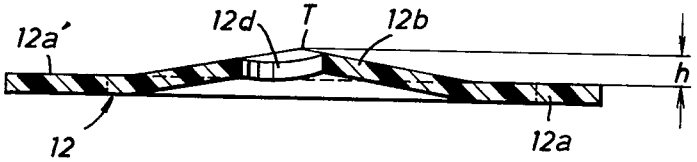
FIG. 5 is a cross-sectional view of the truncated cone shaped sealing plate of FIG. 4.
Figure 6:
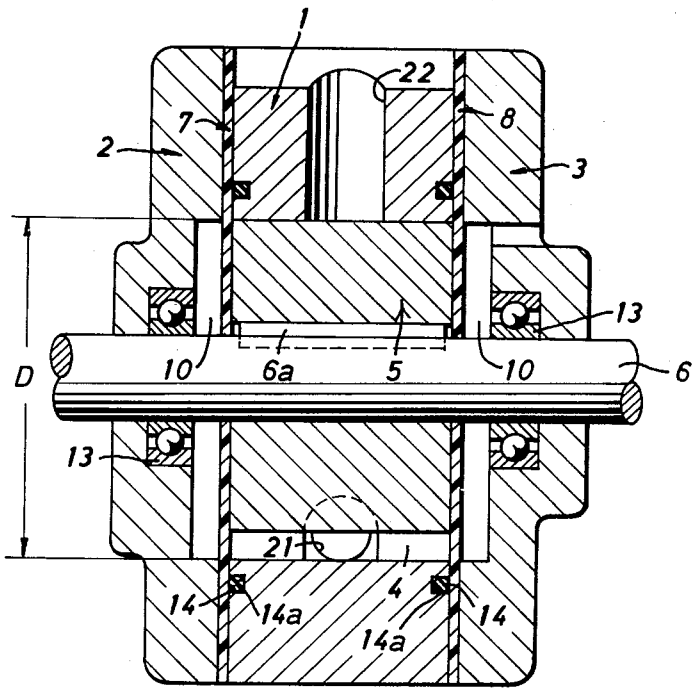
FIG. 6 shows a vertical cross-section of another rotary fluid pump in which the sealing plate shown in FIGS. 4 and 5 may be assembled.

In FIGS. 4 and 5, front and cross-section views of a truncated cone shaped sealing plate 12, the proportions are exaggerated for purposes of illustration. This sealing plate 12 has a flat peripheral flange portion 12*a* to be clamped between stator housing 1 and end head 3 and a truncated cone shaped portion 12*b* extending radially inwardly from flat flange portion 12*a* with a uniform thickness. When sealing plate 12 is assembled with the aforementioned rotary pump, the truncated cone shaped portion 12*b* protrudes axially inwardly to be urged onto the end face of rotor 5 and coincides at its imaginary apex T with the axis of the rotor 5 of which the drive shaft 6 passes through an opening 12*d* provided on the truncated cone shaped portion 12*b*. In this instance, the aforementioned height *h* is measured by the distance from the inner surface 12*a'* of the flat flange portion 12*a* to the imaginary apex T of the truncated cone shaped portion 12*b*. Likewise, FIG. 6 illustrates another type of rotary fluid pump wherein the drive shaft 6 is journalled on the both end heads 2 and 3. In this type of rotary pump, both the conventional sealing plates 7 and 8 are replaced with the truncated cone shaped sealing plate 12.

In operation of an improved rotary fluid pump embodying sealing plates 11 and 12, the cone and truncated cone shaped portions 11*b* and 12*b* of sealing plates 11 and 12 are sufficiently urged onto the opposite end faces of the rotor 5 even when the pump is rotated at a low speed. As a result, the aforementioned end-face sealing contacts are secured between the sealing plates 11 and 12 and the opposite end faces of rotor 5 so that the necessary high vacuum or high positive pressure becomes obtainable during rotation of the pump at a low speed.

Although certain specific embodiments of the invention have been shown and described, it is obvious that many modifications thereof are possible. The invention, therefore, is not intended to be restricted to the exact showing of the drawings and description thereof, but is considered to include reasonable and obvious equivalents.

What is claimed is:

1. In a rotary air pump or compressor including a stator housing, end wall structure mounted on the opposite ends of said stator housing to form a cylindrical pump cavity and a rotor mounted within the pump cavity and co-operating with the inner peripheral wall of said stator housing to form suction, compression and delivery chambers; a flexible sealing plate comprising a flat peripheral flange portion clamped between the end faces of said stator housing and said end wall structure, and a substantially cone shaped portion protruding inwardly from said flat flange portion to be pressed upon assembly onto the end face of said rotor and substantially coinciding at its apex with the axis of said rotor, the height of said cone shaped portion from the inner surface of said flat flange portion being determined in a range of $$\frac{\text{Inner diameter of the pump cavity}}{5 \times 10^2 \text{ to } 5 \times 10^3}.$$

2. In combination with a rotary air pump or compressor comprising:

a stator housing having a cylindrical inner wall;

a pair of end heads mounted on the opposite ends of said stator housing to form a cylindrical pump cavity, each of said end heads being provided at its inner wall with a circular recess corresponding with the cylindrical inner wall of said stator housing;

a drive shaft eccentrically journalled on at least one of said end heads and extending in the interior of the pump cavity;

a rotor mounted on said drive shaft within the pump cavity and co-operating with the cylindrical inner wall of said stator housing to form suction, compression and delivery chambers; and a pair of flexible diaphragm type sealing plates clamped at their outer peripheries between the opposite ends of said stator housing and said end heads to form a pair of pressure chambers within the respective recess of said end heads, said sealing plates being pressed against the opposite end faces of said rotor due to pressure differences between the pump cavity and the pressure chambers to provide end-face sealing contacts;

the improvement wherein each of said sealing plates comprises a flat peripheral flange portion clamped between the end faces of said stator housing and said end head and a substantially cone shaped portion protruding inwardly from said flat flange portion to be pressed upon assembly onto the end face of said rotor and substantially coinciding at its apex with the axis of said rotor, the height of said cone shaped portion from the inner surface of said flat flange portion being determined in a range of $$\frac{\text{Inner diameter of the pump cavity}}{5 \times 10^2 \text{ to } 5 \times 10^3}.$$

3. A rotary air pump or compressor as claimed in claim 2, wherein said drive shaft is journalled on one of said end heads eccentrically to the axis of the inner peripheral wall of said stator housing and wherein one of said sealing plates has a cone shaped portion protruding inwardly from said flat peripheral flange portion and substantially coinciding at its apex with the axis of said rotor, and the other sealing plate has a truncated cone shaped portion protruding inwardly from said flat peripheral flange portion and substantially coinciding at its imaginary apex with the axis of said rotor, said drive shaft passing through an opening of said truncated cone shaped portion.

4. A rotary air pump or compressor as claimed in claim 2, wherein said drive shaft is journalled on said both end heads eccentrically to the axis of the inner peripheral wall of said stator housing and wherein each of said sealing plates has a truncated cone shaped portion protruding inwardly from said flat peripheral flange portion and substantially coinciding at its imaginary apex with the axis of said rotor, said drive shaft passing through openings of said truncated cone shaped portions.

* * * * *